United States Patent [19]

Ishii et al.

[11] Patent Number: 4,667,376

[45] Date of Patent: May 26, 1987

[54] AUTOMATIC LOCKING SLIDER FOR SLIDE FASTENERS

[75] Inventors: Susumu Ishii, Kurobe; Kiyoshi Oda, Namerikawa, both of Japan

[73] Assignee: Yoshida Kogyo K. K., Tokyo, Japan

[21] Appl. No.: 866,861

[22] Filed: May 23, 1986

[30] Foreign Application Priority Data

May 24, 1985 [JP] Japan ..... 60-76409

[51] Int. Cl.[4] ..... A44B 19/30

[52] U.S. Cl. ..... 24/421; 24/422; 24/424

[58] Field of Search ..... 24/421, 424, 419, 422, 24/420

[56] References Cited

U.S. PATENT DOCUMENTS

| | | | |
|---|---|---|---|
| 2,222,529 | 11/1940 | Dahlin | 24/424 |
| 2,511,491 | 6/1950 | Brown | 24/421 |
| 3,320,645 | 5/1967 | Burbank | 24/421 |
| 4,102,022 | 7/1978 | Aoki | 24/421 |
| 4,123,828 | 11/1978 | Akashi | 24/422 |
| 4,287,646 | 9/1981 | Kanzaka | 24/424 |

FOREIGN PATENT DOCUMENTS

| | | | |
|---|---|---|---|
| 239340 | 6/1962 | Australia | 24/419 |
| 678131 | 5/1966 | Belgium | 24/424 |
| 55-17846 | 4/1980 | Japan . | |

*Primary Examiner*—Victor N. Sakran

*Attorney, Agent, or Firm*—Hill, Van Santen, Steadman & Simpson

[57] ABSTRACT

An automatic lock slider for slide fasteners comprises a slider body including an upper and a lower wing defining therebetween a guide channel for the passage of slide fastener coupling elements, a locking member for locking the slider against movement, a pull tab operatively associated with the locking member for manipulating the slider, a casing and a spring member interposed between the casing and the locking member and normally urging the latter in a direction to lock the slider. The casing has retaining lugs interiorly disposed for folding over the spring member to retain the latter in position stably but loosely to permit its resilient movement relative to the locking member.

1 Claim, 10 Drawing Figures

AUTOMATIC LOCKING SLIDER FOR SLIDE FASTENERS

BACKGROUND OF THE INVENTION

1. Field of the Invention:

This invention relates to a slider for slide fasteners, and more particularly to such a slider which is automatically lockable on the slide fastener.

2. Prior Art:

Automatic lock sliders are known, a typical example of which comprises a slider body including upper and lower wings, a pull tab, a locking member, a resilient member and a casing, the locking member being interposed between the pull tab and the resilient member and normally urged in a direction to lock the slider in position on the slide fastener. One such known slide fastener slider disclosed in Japanese Utility Model Publication No. 55-17846 has a resilient member in the form of a leaf spring accommodated in a casing, the spring being supported on a piece of the material of the casing which has been cut and bent adjacent to an opening in the casing through which a pull tab is pivotably mounted. This slider construction has a drawback in that it is not only unsightly in appearance but also mechanically frail because of the presence of such cut and bent piece in the portion of the casing which is subjected to pulling forces upon manipulation of the pull tab.

Another prior art example is shown in U.S. Pat. No. 4,102,022 issued July 25, 1978 in which a slider has a leaf spring supported at opposite ends in recesses formed in a casing. Since it is difficult to hook both ends of the spring in such recesses, the spring being often aloof in the upper portion of the casing, there is provided a tongue-like projection on the leaf spring for engagement with a locking prong to ensure locking of the slider. This structure however necessarily requires increased height of the casing to accommodate such a leaf spring, and hence requires so much thickness of the slider as a whole which makes the slider look unsightly and cumbersome to manipulate.

SUMMARY OF THE INVENTION

It is a primary object of the present invention to provide an automatic lock slider for slide fasteners which will eliminate the foregoing drawbacks of the prior art and which has a casing accommodating a leaf spring securely in operative position, the casing being mechanically strong and relatively low in profile.

According to the invention, an automatic lock slider for slide fasteners comprises a slider body including a guide channel for the passage of slide fastener coupling elements, a locking member for locking the slider against movement, a pull tab operatively associated with the locking member for manipulating the slider, a casing mounted on the slider body to cover the locking member, and a spring member interposed between the casing and the locking member and normally urging the latter in a direction to lock the slider. The casing has retaining lugs interiorly disposed for folding over the spring member to retain the latter in position stably but loosely to permit its resilient movement relative to the locking member.

DETAILED DESCRIPTION

Figure 1:
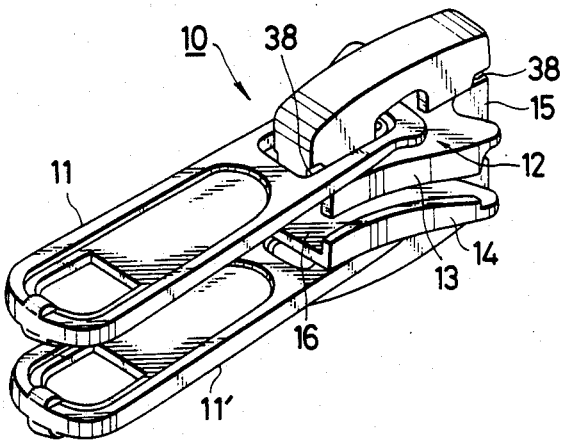
FIG. 1 is a perspective view of a slider embodying the invention.

As shown in FIG. 1, a slide fastener slider 10 of an automatically lockable type includes a pair of pull tabs 11, 11' to be chosen for moving the slider 10 along a pair of rows of coupling elements E (shown by phantom lines in FIG. 9) on the companion fastener stringers F,F to open and close the fastener in a manner well known in the art. The slider 10 comprises a slider body 12 including a pair of flanged wings 13, 14 superposed one on the other and joined at their one ends by a neck 15 so as to define therebetween a substantially Y-shaped guide channel 16 for the passage therethrough of the coupling element rows E on the slide fastener stringers F.

As better shown in FIGS. 8 and 9, the upper and lower wings 13 and 14 are provided symmetrically at one end adjoining the neck 15 with outwardly projecting support posts 17 and 18, respectively, which are substantially structurally identical in that they each have a bearing recess 19 for receiving a support pin 20, 20', later described, and a common through opening 21 extending vertically through the neck 15.

Adjacent to the other end of the slider body 12 opposite to the support posts 17, 18, there are support lugs 22, 23 symmetrically disposed at and projecting outwardly from the upper and lower wings 13 and 14, respectively, the upper support lug 22 having an aperture 24 communicating with the guide channel 16.

A first locking member 25 is associated with the upper wing 13 of the slider body 12 and has, at one of its opposite ends, a bore 26 for receiving the support pin 20, and a downwardly extending link arm 27 received within the common opening 21. The other end of the locking member 25 has a downwardly projecting locking prong 28 movable into and out of the passageway of the coupling element rows E in the guide channel 16.

A second locking member 29 is associated with the lower wing 14 of the slider body 12 and has at its one end an upwardly extending link arm 30 engageable with the downwardly extending arm 27 of the first locking member 25, the other end of the locking member 29 having a locking prong 31 directed toward the locking prong 28 of the first locking member 25 and releasably engageable with the lower wing 14. The locking member 29 further has a bore 32 (FIG. 8) adjacent to the link arm 30 for receiving the pin 20'.

The first and second locking members 25 and 29 are mounted on the respective wings 13 and 14 through the pins 20, 20' about which they are pivotable so as to move the respective locking prongs 28 and 31 toward and away from each other. The two link arms 27 and 30 have abutments 33 and 34, respectively, which are engageable to transmit torque between the two locking members 25 and 29 applied upon manipulation of the pull tabs 11, 11' as hereafter described.

Figure 7:
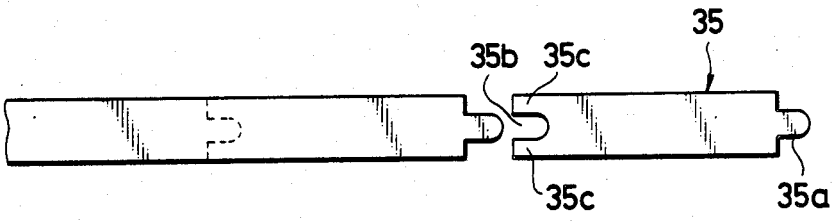
FIG. 7 is a plan view of a series of leaf springs formed successively from a blank sheet material.

A leaf spring 35 is formed successively from a sheet material, as shown in FIG. 7, into a structure having a protuberance 35*a* at one end and a recess 35*b* at the opposite end. The spring 35 is accommodated flexibly within an upper casing 36 and normally urges the first locking member 25 downwardly or in a direction to lock the slider 10 as shown in FIG. 9.

Figure 2:
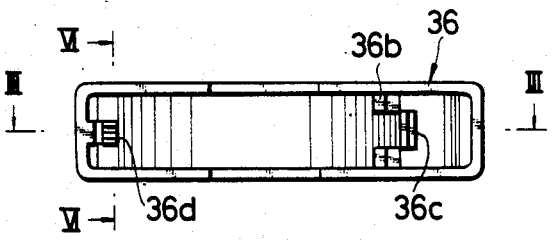
FIG. 2 is a bottom plan view of a casing which constitutes part of the slider of FIG. 1.
Figure 3:
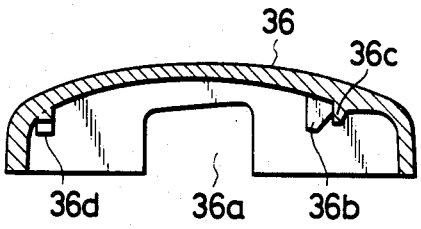
FIG. 3 is a longitudinal cross-sectional view taken along lines III—III of FIG. 2.
Figure 4:
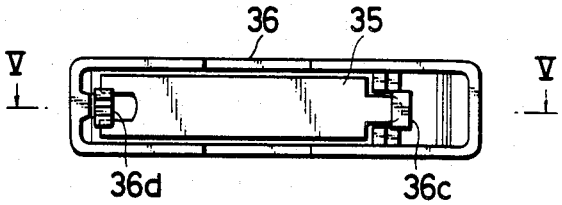
FIG. 4 is a view similar to FIG. 2 but showing a leaf spring mounted in the casing.
Figure 5:
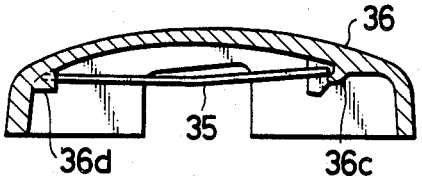
FIG. 5 is a longitudinal cross-sectional view taken along lines V—V of FIG. 4.
Figure 6:
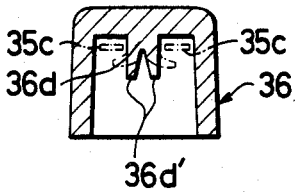
FIG. 6 is a transverse cross-sectional view taken along lines VI—VI of FIG. 2.

FIGS. 2–6, inclusive, show the interior detail of the upper casing 36 in which there are provided a first retaining lug 36*c* depending from an arcuate upper inner wall of the casing 36 adjacent to the front end thereof and a second retaining lug 36*d* also depending from the upper inner wall of the casing 36 adjacent to the rear end thereof. The first retaining lug 36*c* is engaged with the protuberance 35*a* of the leaf spring 35, and the second retaining lug 36*d* is engaged in the recess 35*b* defined by bifurcations 35*c* of the leaf spring 35. More specifically, as shown in FIGS. 4 and 5, the first lug 36*c* in the form of a rectangular flap is folded over the protuberance 35*a*, and the second lug 36*d* is received in the recess 35*b* with its forked ends 36*d'* spread apart and folded over the corresponding bifurcations 35*c* of the leaf spring 35 as shown in FIG. 6, whereby the leaf spring 35 is retained loosely in position within the upper casing 36 stably but loosely to permit its resilient movement relative to the locking member 25.

The pair of pull tabs 11, 11' have their respective trunnions 11*a*, 11'*a* disposed between the upper wing 13 and the first locking member 25 and between the lower wing 14 and the second locking member 29, respectively, and extending transversely across the slider body 12 between the oppositely disposed support posts 17, 18 and between the support lugs 22, 23, respectively, as shown in FIGS. 2–4.

The upper casing 36 and an identical lower casing 37 each has a transverse opening 36*a*, 37*a* through which the trunnions 11*a*, 11'*a* of the pull tabs 11, 11' are passed to permit pivotal movement of the latter as illustrated in FIGS. 3 and 4.

A pin retainer 36*b*, 37*b* (FIGS. 3 and 8) is provided at the inner wall of each of the casings 36, 37 for retaining the pin 20, 20' in position.

As shown in FIG. 1, the upper and lower casings 36 and 37 are mounted over the upper and lower wings 13 and 14, respectively and are secured in place by crimping the material of their corners 38 into side recesses 39 (FIG. 8) of the posts 17, 18 and the lugs 22, 23.

Figure 9:
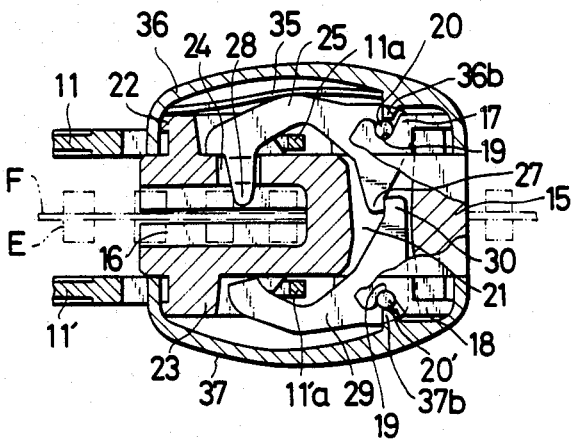
FIG. 9 is a longitudinal cross-sectional view on enlarged scale of the slider of FIG. 1.

As shown in FIG. 9, both pull tabs 11 and 11' are laid rearwardly of the slider body 12 flat against the surfaces of the upper and lower wings 13 and 14, respectively, in which condition the first locking member 25 is urged by the spring 35 to let its prong 28 move toward and rest between the fastener elements E, thereby locking the slider 10 against movement relative to the fastener.

The upper pull tab 11 may be lifted to pull the slider 10 in one direction to open, or in the other direction to close the fastener as is well known. When thus lifting or rotating the pull tab 11 clockwise, the upper locking member 25 rotates about the pin 20 with its prong 28 retracted away from the passageway or guide channel 16 against tension of the spring 35, in which instance the upper locking member 25 and the lower locking member 29 are disengaged at their respective abutments 33 and 34.

The lower pull tab 11' may also conveniently be used to operate the slider 10 from underside.

Figure 10:
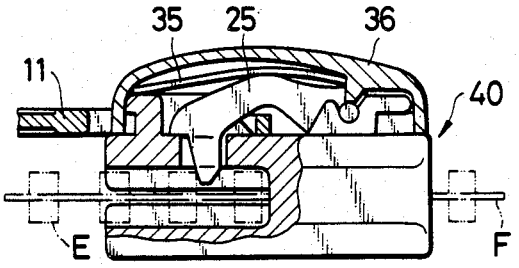
FIG. 10 is a longitudinal cross-sectional view of a modified slider according the present invention.

FIG. 10 illustrates a single pull tab slider 40 incorporating the casing-and-leaf-spring features of the invention. The structural details of the slider 40 is apparent from the foregoing embodiment and a detailed description is not necessary.

Figure 8:
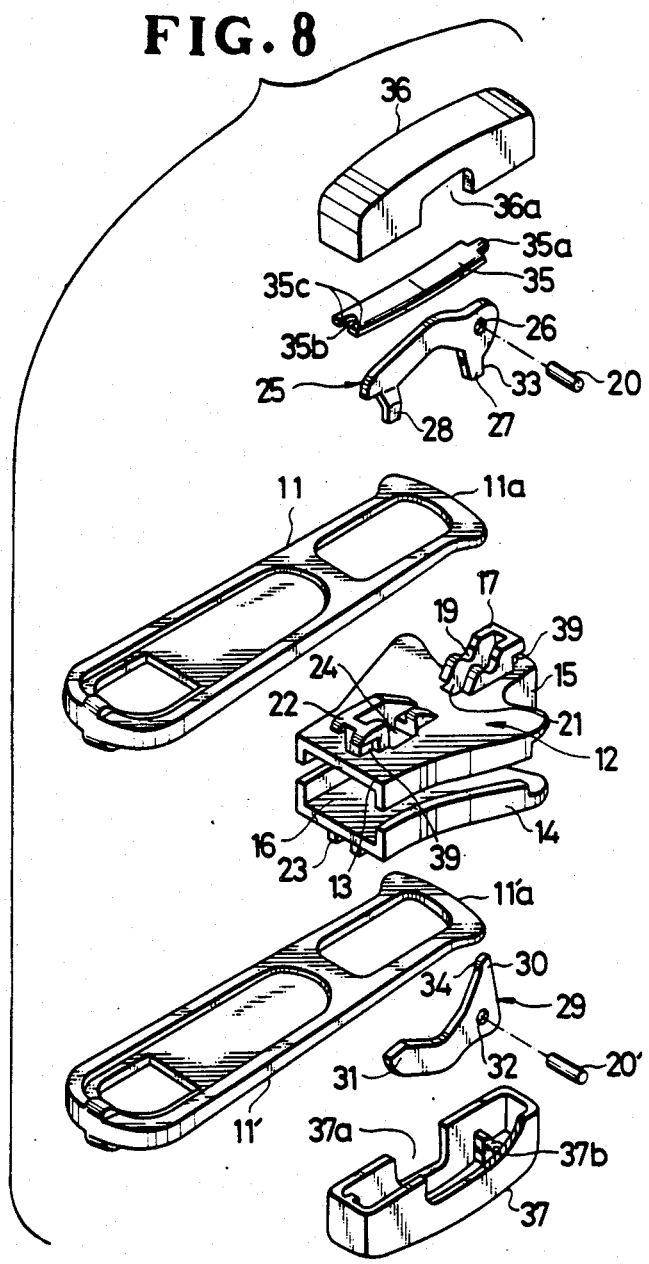
FIG. 8 is an exploded perspective view showing various structural components of the slider of FIG. 1.

Since the leaf spring 35 is provided as a set with the casing 36, the work of assembling of the parts as shown in FIG. 8 can be so much streamlined.

Although various minor modifications may be suggested by those versed in the art, it should be understood that we wish to embody within the scope of the patent warranted hereon, all such embodiments as reasonably and properly come within the scope of our contribution to the art.

What is claimed is:

1. An automatic locking slider for slide fasteners which comprises a slider body including upper and lower flanged wings joined at one end by a neck to define therebetween a substantially Y-shaped guide channel for the passage therethrough of rows of fastener elements, a locking member for locking the slider against movement, a pull tab operatively associated with said locking member, a casing mounted on said slider body to cover said locking member, and a spring member interposed between said casing and said locking member and normally urging said locking member toward said guide channel, said casing having an accurate inner wall facing toward said slider body and having first and second retaining lugs projecting from opposite ends of said inner wall, said lugs having bent end portions with the bent end portion of said first retaining lug being directed toward said second retaining lug and the bent end portion of said second retaining lug comprising a pair of forked ends spread laterally away from one another, said spring member having at one of its opposite ends a protuberance and at another end a pair of bifurcations, said spring member having at opposite ends loosely retained in the bent end portions of the first and second retaining lugs, respectively, and being resiliently flexible relative to said locking member with the forked ends of the second retaining lug being engageable with said pair of bifurcations at said other end of said spring member.

* * * * *